US005557161A

United States Patent [19]

Van Mensvoort

[11] Patent Number: 5,557,161

[45] Date of Patent: Sep. 17, 1996

[54] COLOR DISPLAY TUBE HAVING A MAGNETIC SHEILD WITH A REDUCED MAGNETIC PERMEABILITY AREA

[75] Inventor: Adrianus J. Van Mensvoort, Eindhoven, Netherlands

[73] Assignee: U.S. Philips Corporation, New York, N.Y.

[21] Appl. No.: 326,611

[22] Filed: Oct. 19, 1994

[30] Foreign Application Priority Data

Oct. 22, 1993 [BE] Belgium ..... 09301127
Feb. 28, 1994 [EP] European Pat. Off. ..... 94200504

[51] Int. Cl.[6] ..... H01J 29/06

[52] U.S. Cl. ..... 313/402; 313/479

[58] Field of Search ..... 313/402, 403, 313/404, 405, 406, 407, 408, 479, 313; 174/35 MS

[56] References Cited

U.S. PATENT DOCUMENTS

| | | | |
|---|---|---|---|
| 4,229,675 | 10/1980 | Matsuki et al. | 313/402 |
| 4,758,193 | 7/1988 | Brown | 313/402 |
| 4,792,317 | 12/1988 | Sipsma | 313/402 |
| 5,029,256 | 7/1991 | Tokita et al. | 313/407 |
| 5,412,276 | 5/1995 | Van Mensvoort | 313/402 |

*Primary Examiner*—Sandra L. O'Shea
*Assistant Examiner*—Vip Patel
*Attorney, Agent, or Firm*—Robert J. Kraus

[57] ABSTRACT

Color display tube of the 3-in-line type having a display screen with a pattern of phosphor rows. The display tube has a shield with two long walls, two short walls and one gun-sided aperture. Viewed at least in projection, at least one area having a decreased magnetic permeability and extending in the longitudinal direction of the tube between the edges of the wall and the aperture is present in the material of each long wall.

11 Claims, 5 Drawing Sheets

COLOR DISPLAY TUBE HAVING A MAGNETIC SHEILD WITH A REDUCED MAGNETIC PERMEABILITY AREA

BACKGROUND OF THE INVENTION

The invention relates to a color display tube comprising an envelope with a longitudinal axis, having a neck portion, a funnel portion and a window portion;

an electron gun arranged in the neck portion, a display screen having a short central axis and a long central axis and a pattern of phosphor elements (for example in the form of rows) on the inner surface of the window portion;

a color selection means arranged proximate to the display screen;

a funnel-shaped shield of a magnetically permeable material having two long wall portions parallel to the long axis of the display screen and two short wall portions parallel to the short axis of the display screen, and an aperture at the gun-sided end, which aperture extends transversely to the longitudinal axis and constitutes an aperture for passing electron beams produced by the gun and scanning the display screen.

A color selection means is herein understood to mean, for example an apertured shadow mask sheet or a wire mask.

The ratio between the dimension of the long central axis and the dimension of the short central axis of the display screen characterizes the picture format.

In a (color) display tube the earth's magnetic field deflects the electron paths, which without any measures may be so large that the electrons impinge upon the wrong phosphor (mislanding) and produce a discoloration of the picture.

Modern display tubes are provided with an internal magnetic shield to limit the deviation of the electron path due to the earth's magnetic field. A complete shielding is not possible due to an aperture which is required for the passage of the electron beam. A horizontally directed spot displacement caused by the lateral earth's magnetic field produces a risk of discoloration in the corners only (N effect). It is known from U.S. Pat. No. 4,758,193 that the internal residual field can be influenced by means of an additional measure in such a way that the electron beam still passes the mask at the desired angle. This measure involves the use of a shield with "vertically" directed slits (situated in a plane through the longitudinal axis parallel to the short axis of the display screen). The internal residual field is then influenced in such a way that there is less spot displacement in the horizontal direction. The slits enhance the magnetic resistance in the shield in the horizontal direction so that there is more spot displacement in the vertical direction. However, for display tubes having phosphor rows extending in this direction this is not important because it does not lead to discoloration.

A problem of "vertically" directed slits is that the slit length is to be limited to ensure the mechanical stability of the shield so that an unacceptable spot displacement remains in the corners, particularly in large tubes. In extremely large tubes having, for example a picture diagonal of 41 cm or more, such as 80 cm FS ("Flat Square") and 36 inch WS ("Wide Screen"), i.e. the ratio between the short central axis of the display screen and the long central axis of the display screen is 9:16, it has been attempted to lengthen the slits to a maximum extent and to restore the resultant loss of mechanical strength by welding on strips of a non-ferromagnetic material which bridge the slits. However, the following problems then occur.

1. welding on the strips is a relatively expensive operation,
2. the spot welds are not very reliable (loosening),
3. oil and grease residues behind the welded strips are difficult to remove (risk of cathode poisoning).

It is an object of the invention to provide a display tube of the type described in the opening paragraph in which the earth's magnetic field is shielded as satisfactorily as in the known display tube without detrimentally influencing the mechanical stability of the shield, even in larger tubes having a picture diagonal from, for example 41 cm onwards.

SUMMARY OF THE INVENTION

According to the invention, a display tube of the type described in the opening paragraph is therefore characterized in that in the material of each of the long wall portions of the shield at least one area having a reduced magnetic permeability and extending in the longitudinal direction of the tube is present between the edge of the wall portion and the aperture.

A reduced magnetic permeability is understood to mean a lower permeability as compared with the magnetic permeability of conventional shielding materials for display tubes.

The reduced permeability is obtained by locally giving the material of the wall a treatment decreasing the permeability, as will be described hereinafter. The provision of slits in the material, like in the prior-art display tube shields, can therefore e dispensed with. This leads to a mechanically more stable display tube shield. Further the process of making (stamping) a shield from one metal sheet benefits from the fact that slits are not necessary. The cutting of slits in the formed (borol-shaped) shield is cumbersome. An embodiment of the invention is characterized in that the area having a reduced magnetic permeability in each of the long wall portions has a magnetic permeability which is lower than the permeability in the rest of the relevant wall portion. The invention may also be advantageously used in display tube shields which consist of a plurality of parts. An embodiment of this type is characterized in that the magnetic shield comprises two separate short wall portions and two separate long wall portions whose ends are secured to each other so as to form a funnel-shaped shield, and in that the material of the long wall portions has a lower magnetic permeability than the material of the short wall portions. Since in this construction the long walls (the 6 o'clock and 12 o'clock walls, or the lower and upper walls) can entirely be made from a material having a lower magnetic permeability than the material of the short walls, a treatment for locally decreasing the magnetic permeability is not necessary.

Alternative embodiments of multi-part shields comprise, for example assemblies of two U-shaped or L-shaped bent sheets (so-called folding type shield).

Within the scope of the invention, the magnetic permeability for lateral field of the walls can be reduced in different ways, for example, by local deformation (by means of a centre punch, a powder spray method or laser beam radiation) in the area between the aperture and the edge;

local diffusion of a non-magnetic material suitable for use in an evacuated space, such as Al ,CrNi, Mn, C or N, in the area between the aperture and the edge (note that Al requires a higher temperature during the diffusion process than the other materials mentioned);

local non-decarbonizing annealing by coating a part of the wall surface during annealing;

suppressing the crystal growth by local full annealing before the magnetic annealing step;

local cooling during the magnetic annealing step.

The above-mentioned treatments may be performed on the formed display tube shield. However, in some cases it is advantageous to manufacture the shields from sheet material which has previously undergone a local treatment decreasing the magnetic permeability. The sheet material may be, for example magnetically permeable sheet material having an intermediate portion with a decreased magnetic permeability. In order to keep the conditions for conducting the axial component of the earth magnetic field as good as possible, it is preferred that the areas of reduced permeability each include a plurality of sub-areas each extending in the longitudinal direction of the tube, said sub-areas being spaced by areas of unreduced permeability.

These and other aspects of the invention will be apparent from and elucidated with reference to the embodiments described hereinafter.

DETAILED DESCRIPTION

Figure 1:
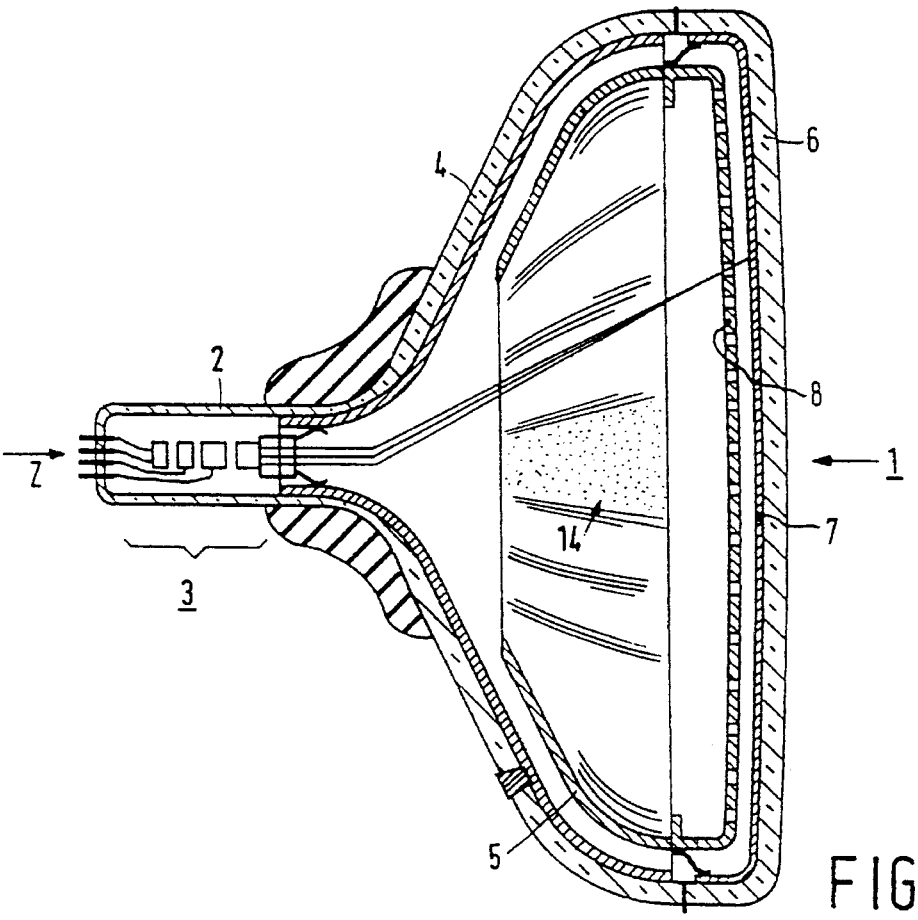
FIG. 1 is a longitudinal elevational view of a colour display tube.

FIG. 1 shows a color display tube 1 having a glass envelope which comprises a neck portion 2 accommodating an electron gun system 3, a funnel-shaped portion 4 within which a magnetic shield 5 is arranged, and a window portion 6 whose inner surface is provided with a display screen 7, in this case having a pattern of phosphors arranged in rows parallel to a central axis of the display screen. A shadow mask 8 is arranged opposite the display screen 7.

The shape of the magnetic shield 5 in display tube 1 roughly follows the contours of the funnel-shaped portion.

Modem display tubes are provided with an internal magnetic shield so as to limit the deviation of the electron path due to the earth's magnetic field. A complete shielding is not possible due to the (gun-sided) aperture required for passing the electron beam. In a lateral field only the horizontally directed spot displacement in the corners causes a risk of discoloration (N effect).

The internal residual field is influenced by means of an additional measure in such a way that the electron beam still passes the mask at the desired angle.

Figure 2A:
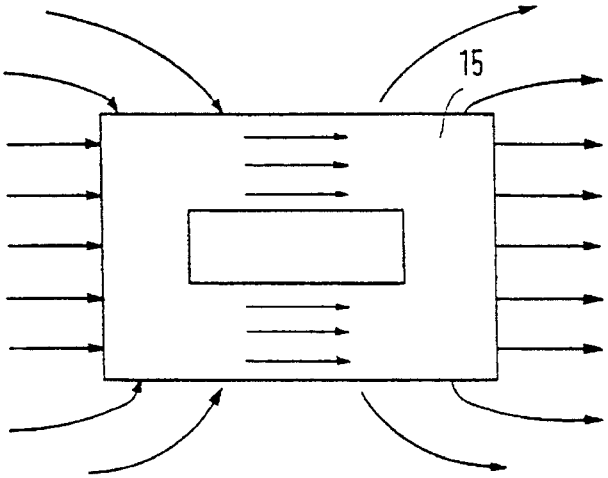
FIG.2A PRIOR ART
FIGS. 2A to 2F are diagrammatic representations to illustrate the beam mislandings on the display screen due to the earth's magnetic field for different shields.

FIG. 2A shows an example of a shield 9 in a rear view, in which no residual field correction is realised.

Figure 2B:
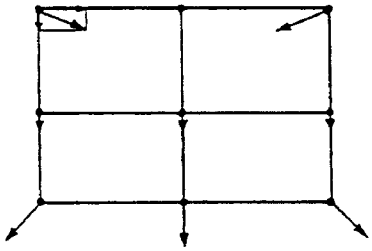

FIG. 2B shows the associated spot displacement in the corners, as occurs in a lateral earth's magnetic field.

Figure 2C:
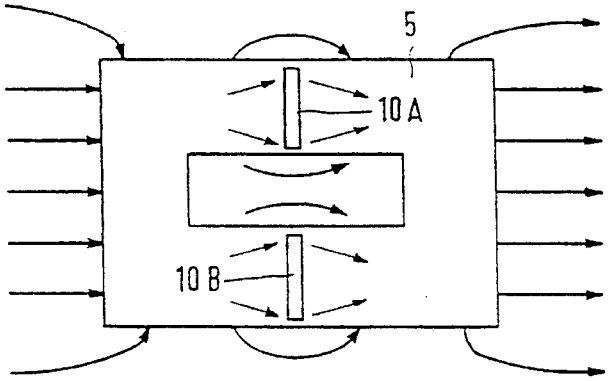
FIG.2C PRIOR ART
Figure 2D:
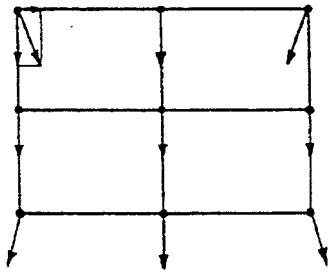

FIG. 2C shows a shield 5 with "vertically" directed slits 10*a*, 10*b*. The internal residual field is influenced thereby in such a way that the spot displacement in the horizontal direction is reduced. The slits increase the magnetic resistance in the shield in the horizontal direction so that there is more spot displacement in the vertical direction (FIG. 2D). However, this is not important for display tubes having their electron guns arranged in one plane, because it does not cause discoloration.

Figure 2E:
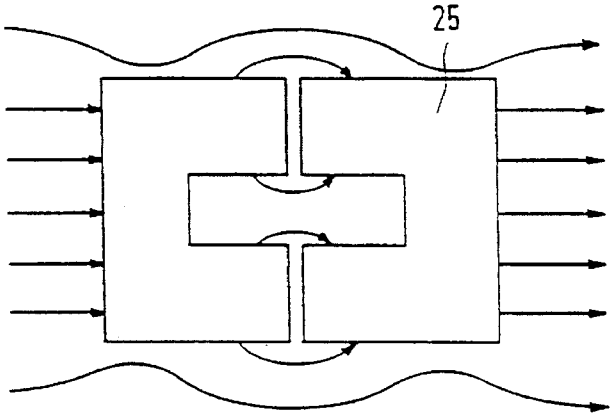
FIG.2E PRIOR ART
Figure 2F:
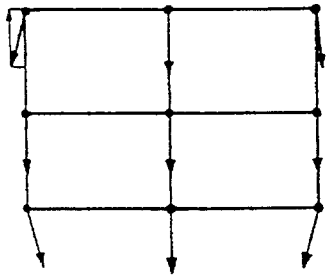

FIG. 2E shows the shield 25 split completely magnetically. Overcompensation of the N effect may even occur in this case (see FIG. 2F).

A problem of the "vertically" directed slits is that the slit length is to be limited to ensure the mechanical stability of the shield. The consequence is that an unacceptable spot displacement remains in the corners, particularly in large tubes.

Within the scope of the invention, no slits are made, but for maintaining the mechanical stability of the shield the magnetic permeability for the lateral component of the earth magnetic field in the area of the afore-mentioned vertically directed slits is reduced, for example by local mechanical deformation and/or by local diffusion of non-magnetic material. Specifically, values of the permeability for transverse field in the areas of reduced permeability which are smaller than turned out to produce practical effects.

Figure 3:
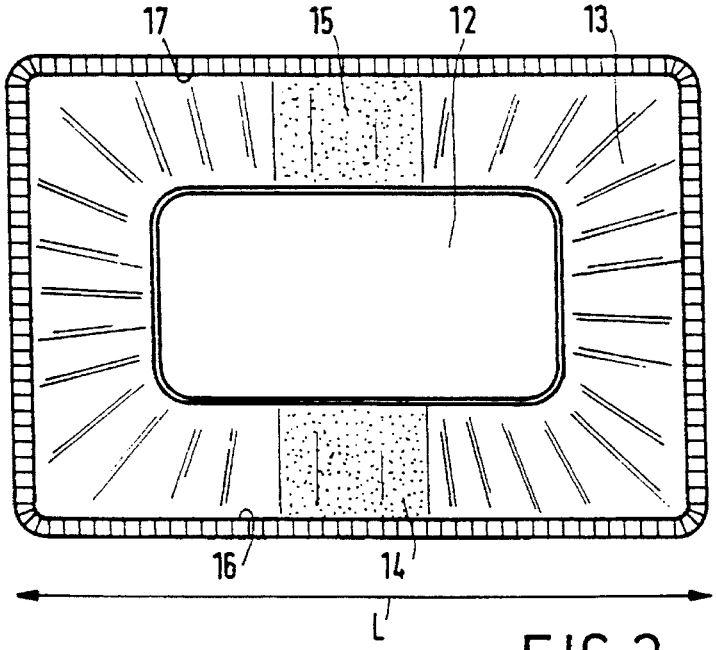
FIG. 3 is a rear view of a single-part display tube shield according to the invention.

FIG. 3 is a rear view of a sheet of iron 13 provided with a central aperture 12 from which a shield 5 (FIG. 1 ) is formed. In areas 14, 15 between the aperture 12 and the opposite edges 16, 17 the magnetic permeability of the material is reduced over a length 1 by means of a special treatment. This treatment may be a mechanical deformation (for example, by means of a centre punch) or a deformation by means of a laser beam, or, very effectively, diffusion of non-magnetic material (for example Al, CrNi, Mn, C or N).

Figure 4:
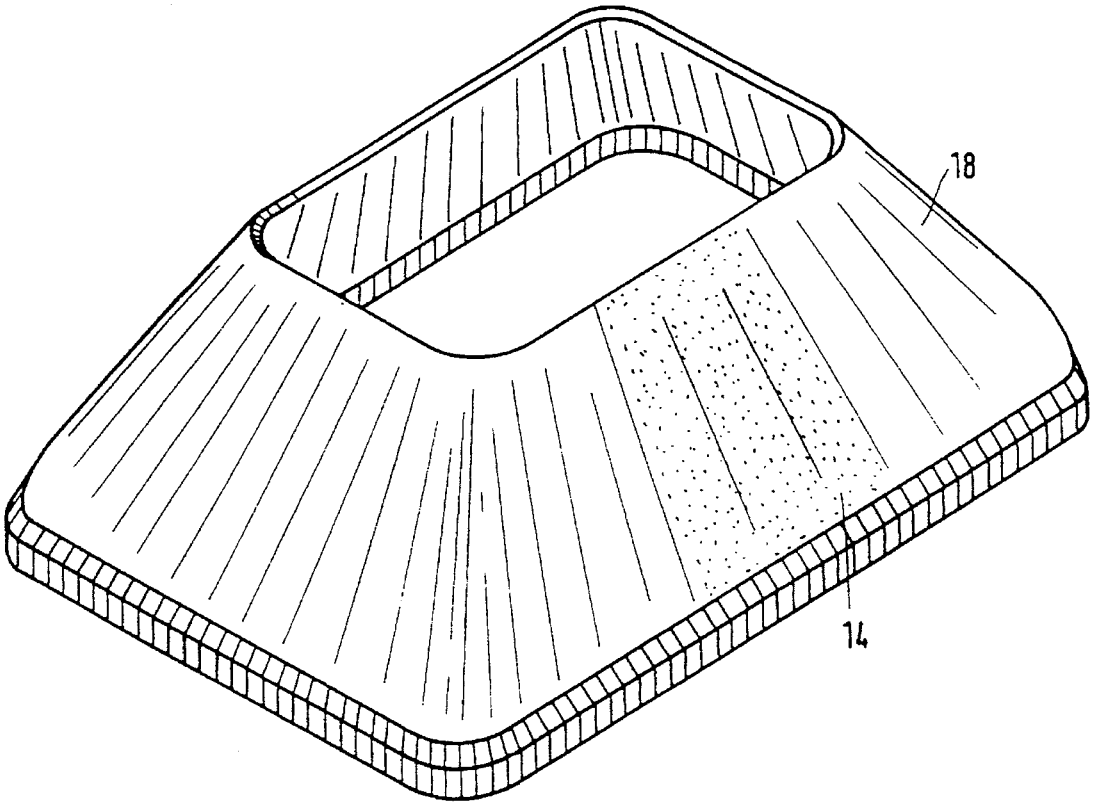
FIG. 4 is a perspective elevational view of a single-part display tube shield according to the invention.

FIG. 4 is a perspective elevational view of a shield formed from sheet material having a long wall portion 18, a transversal area 14 of which has a decreased magnetic permeability so as to render the magnetic resistance in the lateral direction sufficiently large. The width of the area 14 may range from some mm to some cm and even to a considerable part of the length L of the original sheet. In the latter case, widths of 5% or 10% or more of the length L of the original sheet may be concerned, dependent on the extent to which the permeability in the area 14 has been decreased.

In particular the following relation holds:

$$\mu \leqq 2\frac{a}{\pi t}\ln\left(\frac{L}{a}\right),$$

in which $\mu_r$ represents the (reduced) relative permeability of area 14, t the thickness of the shield material, a the width of area 14, and L the (mean) length of the shield portion which includes area 14, measured in the direction of the applied (lateral) field. E.g. if a=2,5 m; t=150 μm; L=75 mm, the requirement is that $\mu_r \leqq 120$.

Figure 5:
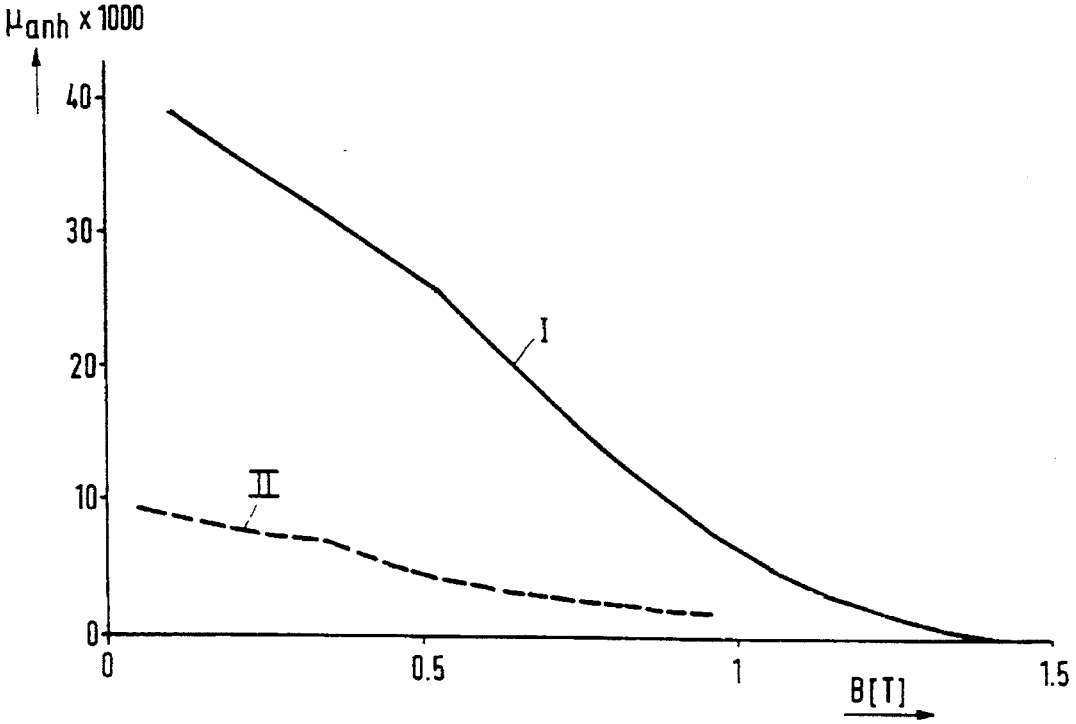
FIG. 5 shows a graph in which the anhysteresis permeability $\mu_{anh}$ of an iron sheet before and after Al diffusion is plotted.

Stringent requirements are imposed on the shield material. The saturation magnetization should be high so as to remove much flux with little material. The magnetic permeability must be high. This relates specifically to a permeability at demagnetization, referred to as the anhysteresis magnetization curve. The anhysteresis μ is much higher for low-carbon steel than the initial μ of, for example μ metal. The coercive field should be low so as to dissipate minimal energy during demagnetization. Yet, some coercive field should remain so as to maintain the pole distributions fixed during demagnetization. The effect of diffusing Al on the permeability is shown in FIG. 5. In this Figure curve I shows the anhysteresis permeability $\mu_{anh}$ of a sheet of iron (VK steel thickness, for example between 0.05 and 0.8 mm) (after annealing $\mu_{anh}$ at a temperature of 750° C.), and curve II shows the anhysteresis permeability $\mu_{anh}$ of the same sheet of iron (after annealing at a temperature of 720° C.) in which Al is diffused at a temperature of 600° C. in an area having a width of 4 cm. There is a decrease of the permeability throughout the range of magnetic inductance values B between 0 and 1 Tesla. For an even larger effect, the diffusion of Al may be combined, for example with a deformation step (for example, sandblasting). The above-mentioned method enables control of the magnetic permeability over a larger range than is possible if slits are provided in a shield.

Figure 6:
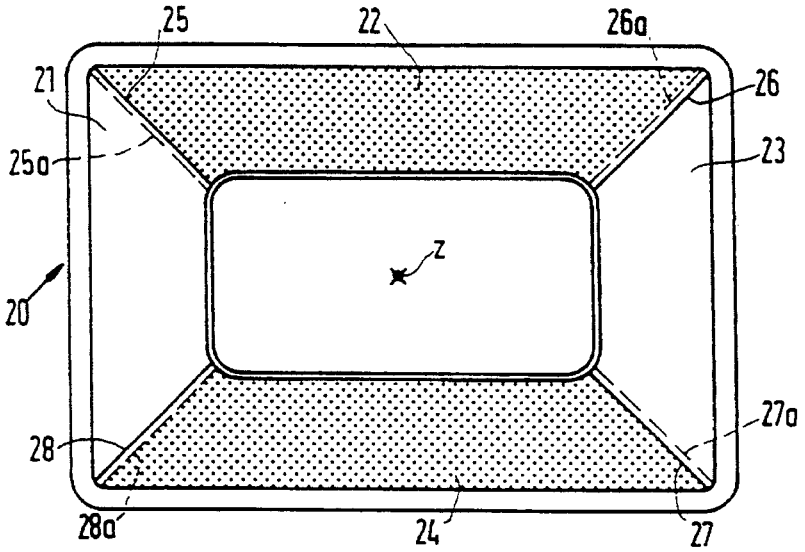
FIGS. 6, 7 and 8 are rear views of multi-part display tube shields according to the invention.

FIG. 6 shows a shield 20 composed of two long portions 22, 24 and two short portions 21, 23 which are secured to each other, in this case by causing the ends 25, 25*a*; 26, 26*a*; 27, 27*a* and 28, 28*a* to overlap and to be welded to each other. The long portions 22, 24 are made of a material having a decreased magnetic permeability as compared with the magnetic permeability of conventional display tube shield material, whereas the short portions 21, 23 are made of a conventional display tube shield material.

Figure 7:
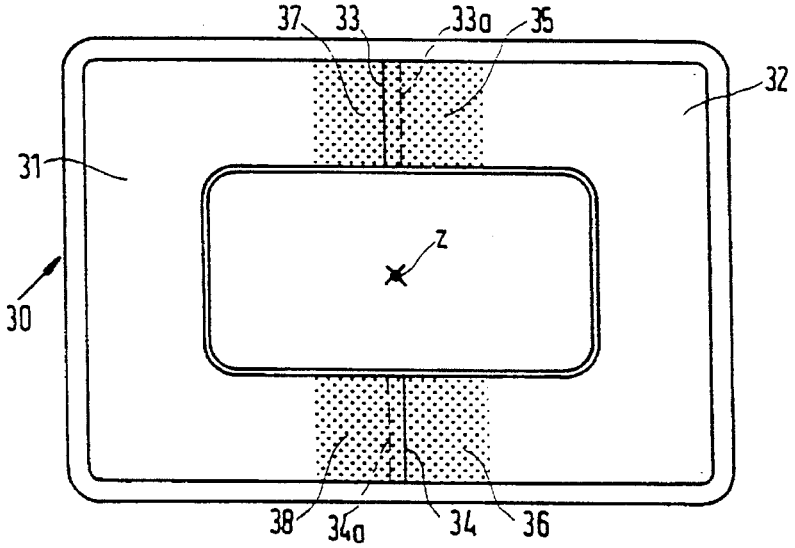

FIG. 7 shows a shield 30 which is composed of two U-shaped bent portions 31, 32 which are secured to each other, in this case by causing the ends 33, 33*a* and 34, 34*a* to overlap and to be welded to each other. Portion 31 is treated for obtaining areas 37, 38 having a decreased magnetic permeability in the long walls and portion 32 is treated for obtaining areas 35, 36 having a decreased magnetic permeability in the long walls.

Figure 8:
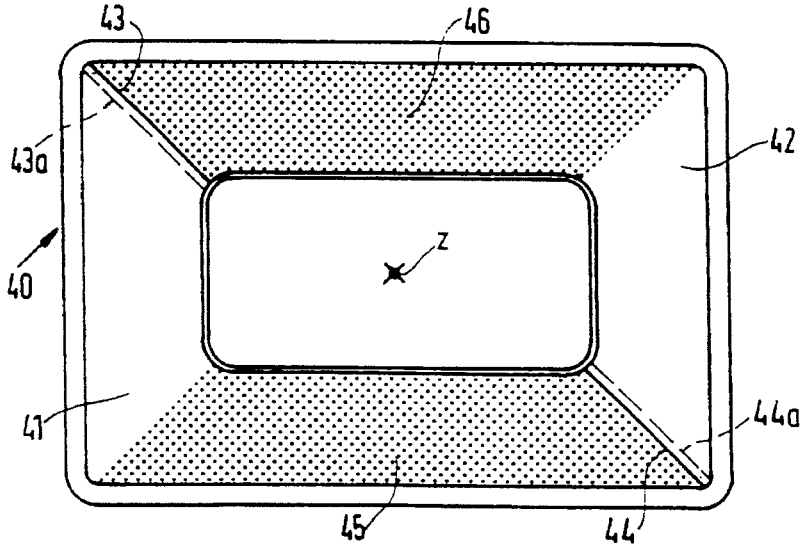

FIG. 8 shows a shield 40 which is composed of two L-shaped bent portions 41 and 42 which are secured to each other, in this case by causing the ends 43, 43*a* and 44, 44*a* to overlap. The portions 41 and 42 are treated for obtaining areas 45, 46 having a decreased magnetic permeability in the long walls.

Figure 9:
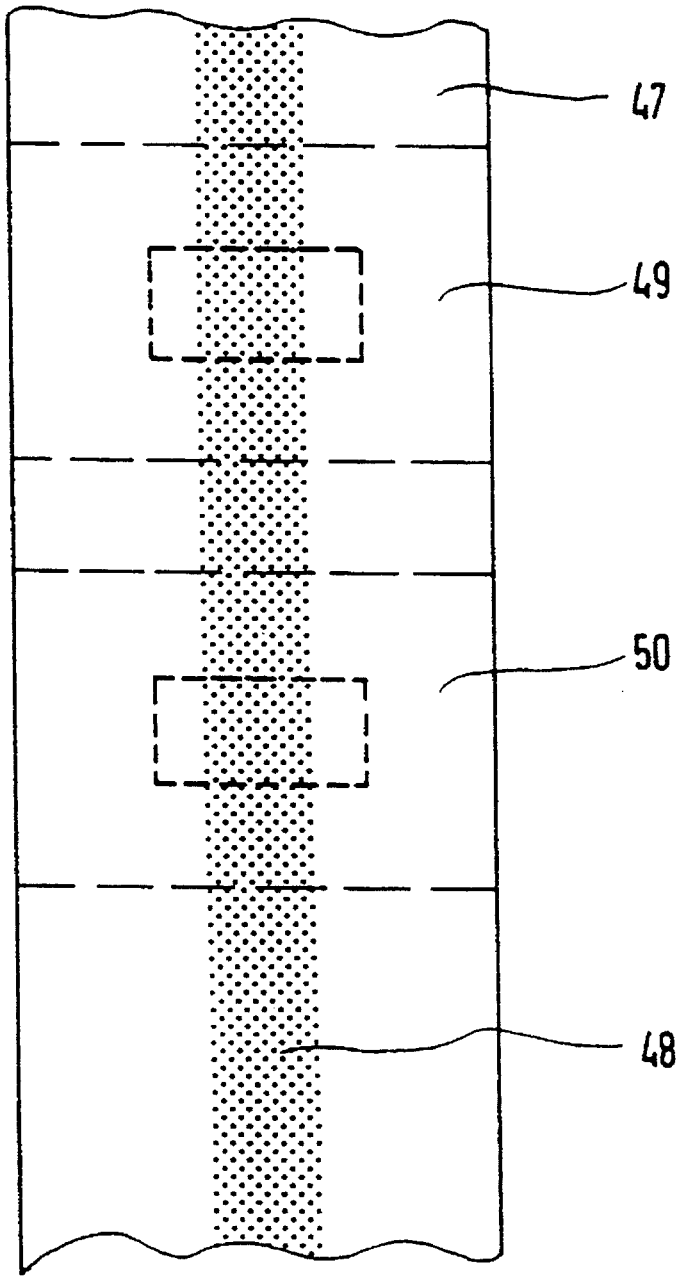
FIG. 9 shows a strip of sheet material from which display tube shields of the type according to the invention can be manufactured.

FIG. 9 is a plan view of a portion of a metal strip 47 of magnetically permeable material whose intermediate portion 48 is treated for obtaining a decreased magnetic permeability. As is shown diagrammatically by means of broken lines, a plurality of display tube shields 49, 50 of the type according to the invention may be made from this sheet material. The material which is conventionally used for display tube shields may be used for the strip 47, such as (cold-rolled) AK steel or low-carbon (cold-rolled) steel.

An internal shield has been referred to in the foregoing. However, the invention is not limited thereto and may alternatively be used to advantage for an external magnetic shield.

I claim:

1. A color display tube comprising an envelope with a longitudinal axis, having a neck portion, a funnel portion and a window portion;

an electron gun arranged in the neck portion;

a display screen having a short central axis and a long central axis and a pattern of phosphor elements on the inner surface of the window portion;

a color selection means arranged proximate to the display screen;

a funnel-shaped shield of a magnetically permeable material having two long wall portions parallel to the long axis of the display screen, each of the long wall portions of the shield having at least one apertureless area having a reduced magnetic permeability, and extending in the longitudinal direction of the tube between the edge of the wall portion and the aperture; and two short wall portions parallel to the short axis of the display screen, and an aperture at the gun-sided end, which aperture extends transversely to the longitudinal axis and constitutes an aperture for passing electron beams produced by the gun and scanning the display screen.

2. A color display tube as claimed in claim 1, characterized in that each area of reduced permeability includes a plurality of sub-areas each extending in the longitudinal direction of the tube, said sub-areas being spaced by areas of unreduced permeability.

3. A color display tube as claimed in claim 1, characterized in that the area having a reduced magnetic permeability in each of the long wall portions has a magnetic permeability which is lower than the permeability in the rest of the relevant wall portion.

4. A color display tube as claimed in claim 1, characterized in that the magnetic shield comprises two separate short wall portions and two separate long wall portions whose ends are secured to each other so as to form a funnel-shaped shield, and in that the material of the long wall portions has a lower magnetic permeability than the material of the short wall portions.

5. A color display tube as claimed in claim 1, characterized in that the magnetic shield comprises two U-shaped bent metal sheets whose ends are secured to each other so as to form a funnel-shaped shield, each U-shaped bent metal sheet having two portions which are parallel to the long axis of the display screen, while the area having a reduced magnetic permeability is located in at least one of said portions.

6. A color display tube as claimed in claim 1, characterized in that the magnetic shield comprises two L-shaped bent metal sheets whose ends are secured to each other so as to form a funnel-shaped shield, each L-shaped bent sheet having a portion which is parallel to the long axis of the display screen, while the area having a reduced magnetic permeability is located in at least one of said portions.

7. A color display tube as claimed in claim 1, characterized in that the areas having a reduced magnetic permeability have been realised after the formation of the funnel shape.

8. A color display tube as claimed in claim 1, characterized in that the areas having a reduced magnetic permeability have been realised before the formation of the funnel shape.

9. A color display tube as claimed in claim 1, characterized in that the window portion has a picture diagonal of at least 41 cm.

10. A color display tube as claimed in claim 1, characterized in that the ratio between the short central axis of the display screen and the long central axis of the display screen is 9:16.

11. A color display tube as claimed in claim 1, in which the magnetic shield comprises a number of sheets that have different magnetic properties and whose ends are secured together so as to form a funnel-shaped shield, the area with reduced permeability being present in the portion of the shield which is parallel to the long axis of the display screen.

* * * * *